US011969038B2

(12) United States Patent
Rahming

(10) Patent No.: US 11,969,038 B2
(45) Date of Patent: Apr. 30, 2024

(54) HYGIENIC PROTECTIVE COVER FOR PUBLIC SURFACES

(71) Applicant: Constance Rahming, New York, NY (US)

(72) Inventor: Constance Rahming, New York, NY (US)

(73) Assignee: Constance T Rahming, New York, NY (US)

( * ) Notice: Subject to any disclaimer, the term of this patent is extended or adjusted under 35 U.S.C. 154(b) by 329 days.

(21) Appl. No.: 17/407,130

(22) Filed: Aug. 19, 2021

(65) Prior Publication Data

US 2023/0058688 A1 Feb. 23, 2023

(51) Int. Cl.
*A41D 19/015* (2006.01)
*A41D 19/00* (2006.01)

(52) U.S. Cl.
CPC ... *A41D 19/01558* (2013.01); *A41D 19/0006* (2013.01)

(58) Field of Classification Search
CPC ..... A41D 19/01588; A41D 19/01582; A41D 19/0093; A41D 19/002; A41D 13/082; A41B 15/00; B62B 5/069; F16F 1/24; F16F 1/187
See application file for complete search history.

(56) References Cited

U.S. PATENT DOCUMENTS 690,302 A * 12/1901 Lee ..... A41D 13/082 294/25
950,633 A * 3/1910 Eastman ..... A63B 31/10 2/20
1,714,648 A * 5/1929 Walker ..... A41D 13/082 2/164
1,773,440 A * 8/1930 Sbrolla ..... A63B 31/04 441/57
2,695,999 A * 12/1954 Arnold ..... A41D 13/082 D2/622
4,487,412 A * 12/1984 Meeko ..... A63B 21/4021 482/106
4,754,499 A * 7/1988 Pirie ..... A41D 13/082 294/25

(Continued)

FOREIGN PATENT DOCUMENTS

CN 203020126 U 6/2013
DE 202013006457 U1 * 9/2013 ..... A41D 19/01

(Continued)

*Primary Examiner* — Jillian K Pierorazio

(57) ABSTRACT

A hygienic protective cover for public surfaces includes a thin flexible panel of spring metal, coated with a layer of silicone. The spring metal can be a bi-stable ribbon spring. The spring metal composition of the flexible panel is configured to transfer between a straight, semi-rigid form and a curved form adapted to wrap around an exterior surface of a public handle, when forcibly applied to the public handle. A silicone layer encapsulates the panel to minimize transfer of germs. A protruding grip on the outer side of the panel enables the user to grip and manipulate the panel when wrapped around the public handle. The device is sized and dimensioned to be easily carried on a public transportation vehicle, such that a user can wrap the device around a section of the public handle to help prevent direct contact with the exterior surface thereof.

16 Claims, 8 Drawing Sheets

(56) References Cited

U.S. PATENT DOCUMENTS 4,938,515 A * 7/1990 Fazio ..... A41D 13/082 2/21
5,603,679 A * 2/1997 Reis ..... A63B 21/4019 482/106
5,864,925 A * 2/1999 McGee ..... A63B 57/20 24/3.13
6,898,802 B1 * 5/2005 Suarkeo ..... A41D 13/082 2/20
7,117,536 B2 * 10/2006 Burnett ..... A41D 13/087 2/161.6
7,347,019 B1 * 3/2008 Shaw ..... F16F 1/025 40/607.01
10,743,554 B1 * 8/2020 Allen ..... A41D 19/015
2002/0000455 A1 * 1/2002 Condliff ..... A45F 5/004 224/162
2006/0084557 A1 * 4/2006 Kassel ..... A63B 21/4021 482/44
2009/0133789 A1 5/2009 Hall
2009/0056844 A1 6/2009 Schanz
2009/0193560 A1 * 8/2009 Provezano ..... A63B 71/14 2/21
2010/0314427 A1 * 12/2010 Cartwright ..... A45F 5/004 43/53.5
2012/0023632 A1 * 2/2012 Provenzano ..... A41D 13/082 2/16
2012/0240307 A1 9/2012 Terrell et al.
2014/0000984 A1 * 1/2014 Thornton ..... A63B 21/4037 185/37
2019/0365003 A1 * 12/2019 Barton ..... A41D 27/24
2021/0289857 A1 * 9/2021 LaManche ..... A41D 19/0048
2021/0337900 A1 * 11/2021 Banks ..... A41D 13/081

FOREIGN PATENT DOCUMENTS

DE 102011101311 B4 * 1/2015 ..... A41D 13/082
DE 202020001930 U1 * 9/2020 ..... A41D 13/081
EP 2481310 A1 * 8/2012 ..... A41D 19/0041

* cited by examiner

HYGIENIC PROTECTIVE COVER FOR PUBLIC SURFACES

FIELD OF THE INVENTION

The present invention relates generally to a hygienic protective cover for public surfaces. More so, the present invention relates to a hygienic protective cover comprising a thin flexible panel of spring metal, coated with a layer of silicone, that is configured to transfer between a straight, semi-rigid form and a curved form adapted to wrap around an exterior surface of a public handle, and which is easily carried on a public transportation vehicle for preventing direct contact with the exterior surface of the public handle.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, bi-stable springs have two equilibrium positions. This allows a device with a bi-stable spring to assume two distinct configurations. The most recent widespread use of such a device was the slap bracelet, also called the slap wrap. The slap bracelet consists of layered flexible steel bands sealed within a fabric cover. Typical slap bracelets are roughly one inch in width by nine inches in length. In a first equilibrium position they can be flat. The second equilibrium is typically reached by slapping the flat embodiment across the wrist, at which point the bracelet curls around the wrist and stays relatively secure in a roughly circular position.

Other proposals have involved hygienic covers for public transportation handles. The problem with these protective gripping devices is that they do easily wrap around the handle and unwrap from the handle. Also, the cover does not have a silicone layer as a barrier against germs. Even though the above cited hygienic covers for public transportation handles meet some of the needs of the market, a hygienic protective cover for public surfaces and method of use comprising a thin flexible panel of spring metal, coated with a layer of silicone, that is configured to transfer between a straight, semi-rigid form and a curved form adapted to wrap around an exterior surface of a public handle, and which is easily carried on a public transportation vehicle for preventing direct contact with the exterior surface of the public handle is still desired.

SUMMARY

Illustrative embodiments of the disclosure are generally directed to a hygienic protective cover for public surfaces. The protective cover device includes a thin flexible panel of spring metal, coated with a layer of silicone. The spring metal composition of the flexible panel is configured to transfer between a straight, semi-rigid form and a curved form adapted to wrap around an exterior surface of a public handle, when forcibly applied to the public handle. The hygienic protective cover is sized and dimensioned to be easily carried on a public transportation vehicle, such that a user can wrap the cover around a section of the public handle to help prevent direct contact with the exterior surface thereof.

In one aspect, the hygienic protective cover device, comprises:

- a flexible panel defining an inner side and an outer side, the panel comprising a spring metal material, the spring metal configured to enable the panel to transfer between a straight, semi-rigid form and a curved form; and
- a silicone layer encapsulating the panel, the silicone layer comprising a silicone material configured to minimize the transfer of germs.

In a second aspect, the spring metal comprises a bi-stable ribbon spring.

In another aspect, the panel has a first end and a second end.

In another aspect, the device further comprises a protruding grip disposed on the outer side.

In another aspect, the silicone layer encapsulates the protruding grip.

In another aspect, the protruding grip is elongated.

In another aspect, the protruding grip comprises multiple ridges adapted to receive the fingers.

In another aspect, the panel defines a perimeter region.

In another aspect, the panel defines an aperture disposed at the perimeter region.

In another aspect, the aperture enables passage of a lanyard.

In another aspect, the aperture defines a rectangular shape.

In another aspect, the straight, semi-rigid form of the panel defines a rectangular shape.

In another aspect, the curved form of the panel is adapted to completely wrap around an exterior surface of a public handle.

In another aspect, the public handle comprises a vertical or horizontal handle bar in a public transportation vehicle.

One objective of the present invention is to protect the hands from contamination and germs on public transportation.

Another objective is to rapidly place and remove the panel around the public handle.

Yet another objective is to provide a lightweight, portable panel that can easily be carried to public transportation.

An exemplary objective is to provide a gripping means for enhanced control of the cover device.

Additional objectives are to provide an inexpensive to manufacture hygienic protective cover device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 3A shows the panel wrapped around the public handle in a counter-clockwise direction, and FIG. 3B shows the panel wrapped around the public handle in a clockwise direction, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
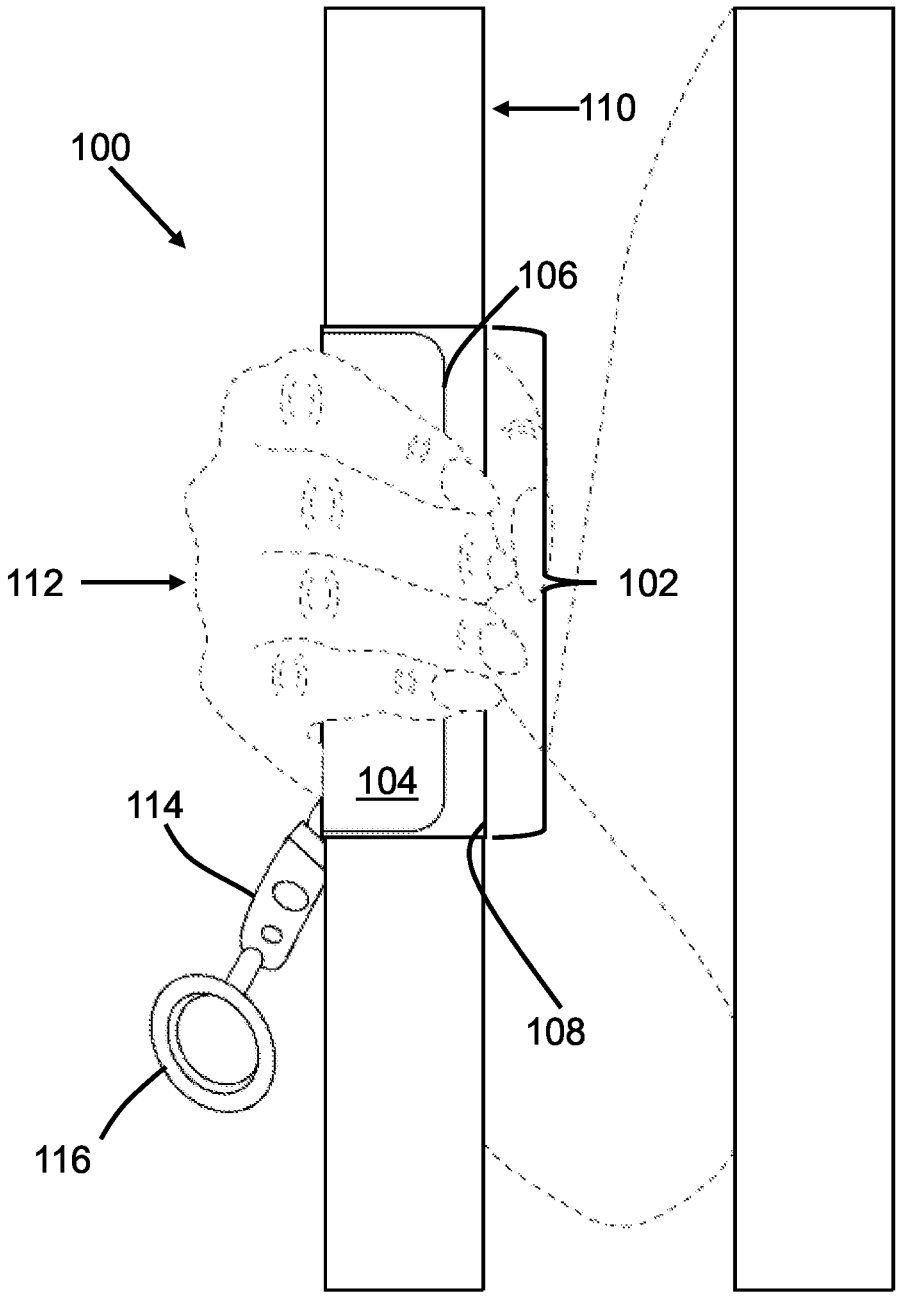
FIG. 1 illustrates a perspective view of an exemplary hygienic protective cover device covering a public handle, in accordance with an embodiment of the present invention.

A hygienic protective cover for public serves is referenced in FIGS. 1-10. A hygienic protective cover device 100, hereafter "device 100" includes a thin flexible panel 102 comprised of a spring metal 502, and coated with a silicone layer 504 to protect against germs. As illustrated in FIG. 1, the spring metal 502 composition of the panel 102 is configured to enable the panel 102 to transfer between a straight, semi-rigid form 800, and a curved form 500 adapted to securely wrap around an exterior surface of a public handle 110, when forcibly applied to the public handle 110. The device 100 is sized and dimensioned to be easily carried on a public transportation vehicle, such that a user can wrap the panel 102 around a section of the public handle 110 to help prevent direct contact with the exterior surface thereof.

Those skilled in the art will recognize that a spring metal 502 material, such as a bi-stable ribbon spring, has unique characteristics in that the spring metal 502 material has a first stable linear state and a second stable coiled state. It is known in the art that such springs have been incorporated into "slap bracelets" which are short (approximately 6" to 9" long) bi-stable springs contained within a cloth sack. Such bi-stable snap springs have also been labeled and used as tape measures that can assume a first stable linear state and a second stable coiled state. The present disclosure utilizes such a bi-stable ribbon spring in a similar mechanical operation, but for use as a hygienic cover for public handles 110.

Figure 2:
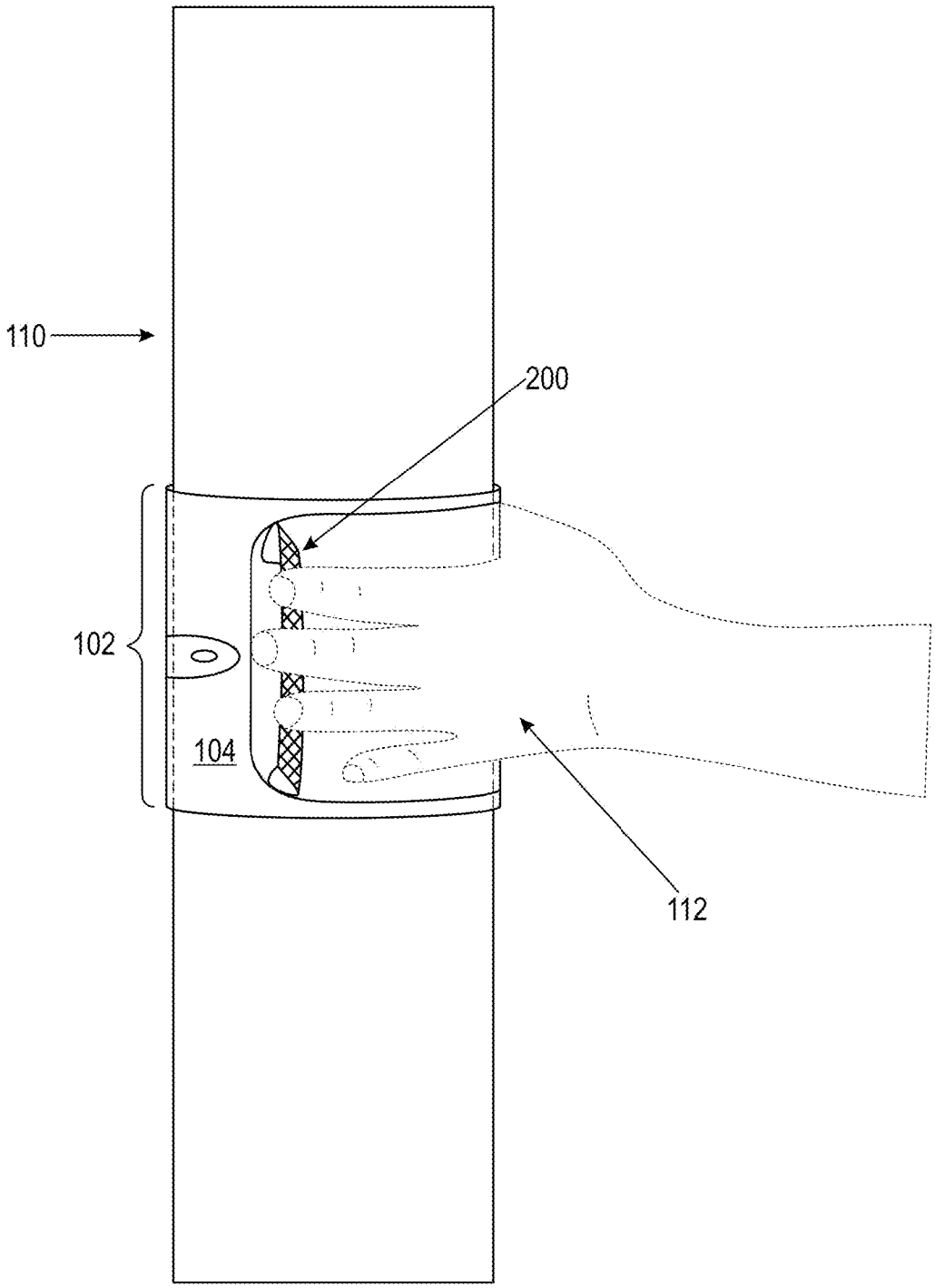
FIG. 2 illustrates a perspective view of the hygienic protective cover device wrapped around the public handle in a counter-clockwise direction, in accordance with an embodiment of the present invention.

As referenced in FIG. 2, the device 100 comprises a flexible panel 102 that defines an inner side 900 and an opposing outer side 104. The panel 102 is fabricated from a spring metal 502 material, or a bi-stable ribbon spring, or other coil-style metal bands and coils known in the art. In one non-limiting embodiment, the spring metal 502 comprises a bi-stable ribbon spring. The spring metal 502 is configured to enable the panel 102 to transfer between a straight, semi-rigid form 800 and a curved form 500.

For example, as the inner side 900 of the panel 102 is forcibly slapped against a public handle 110, the spring metal 502 material enables the panel 102 to snugly wrap around the public handle 110. When flexed the panel 102 self-coils around the public handle 110 assuming a first stable coiled state. The user's hand 112 may then securely grip the panel without contacting the public handle 110. The After use, the panel 102 can be removed and straightened to assume a second stable linear state.

Figure 3A:
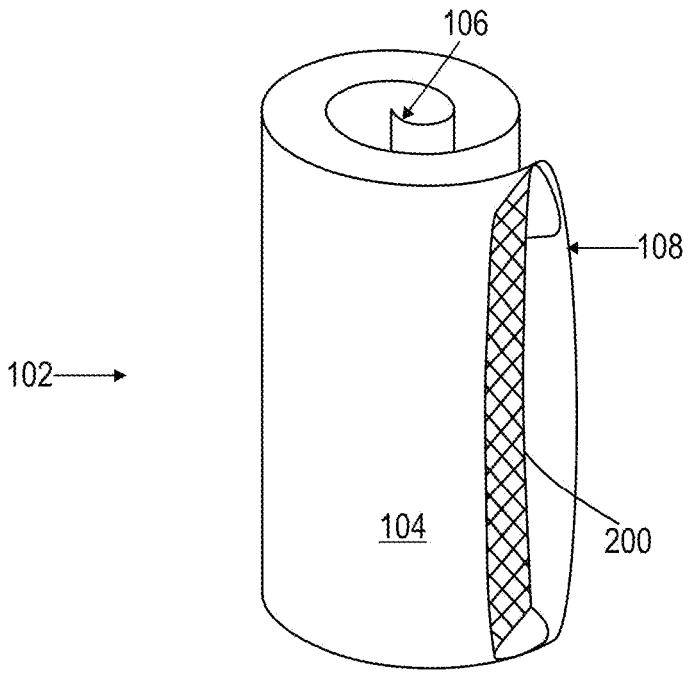
FIGS. 3A-3B illustrate perspective views of an exemplary panel having a spring metal composition, where
Figure 3B:
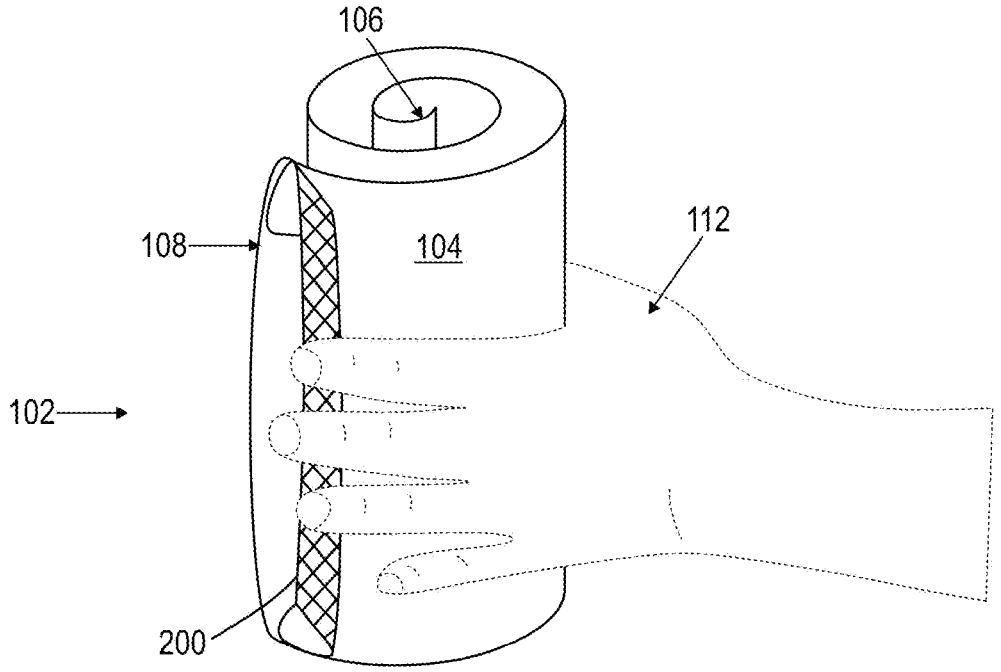
Figure 4:
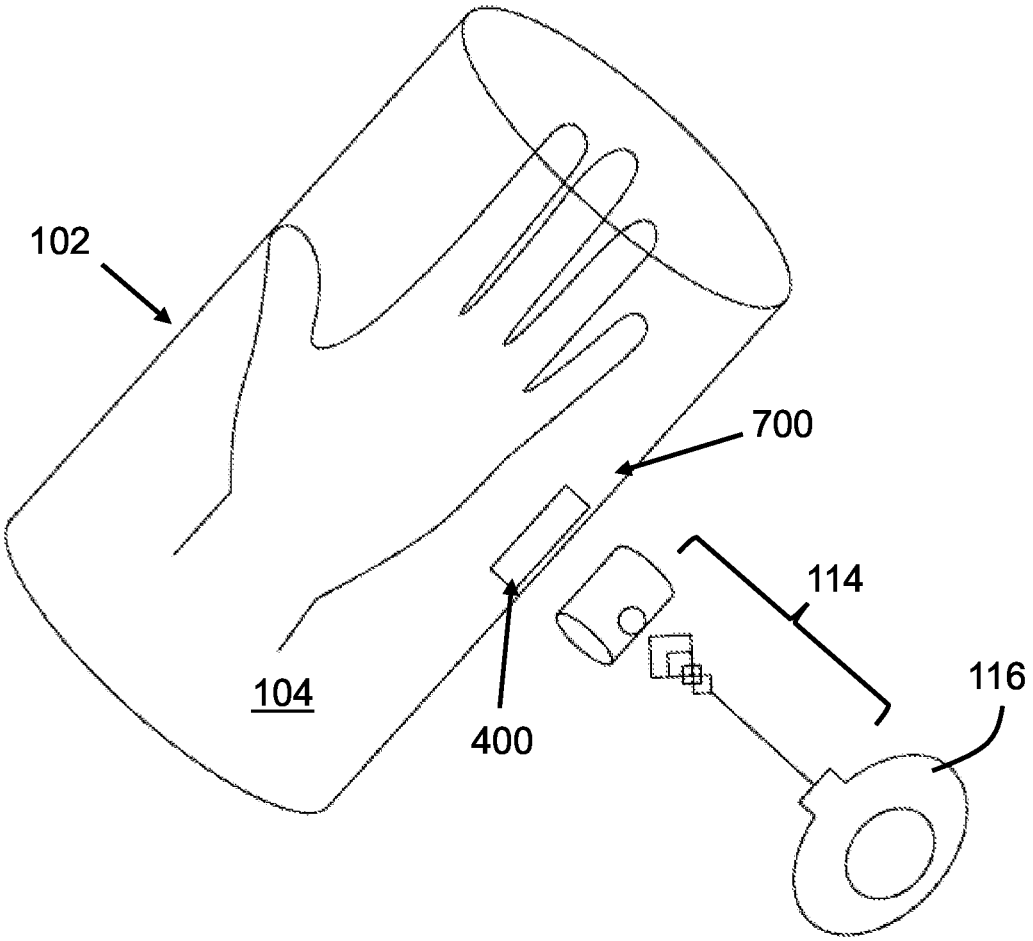
FIG. 4 illustrates a blown-up view of an exemplary lanyard attached to the panel, in accordance with an embodiment of the present invention.

As shown in FIG. 3A, the panel 102 also has a first end 106 and an opposing second end 108. The first end 106 is the end that strikes the public handle 110 first, when the panel 102 is forcibly thrown against the public handle 110. The second end 108 is more proximal to the point where the user grips the panel 102 when throwing the panel 102 against the public handle 110 (See FIG. 3B).

Figure 5:
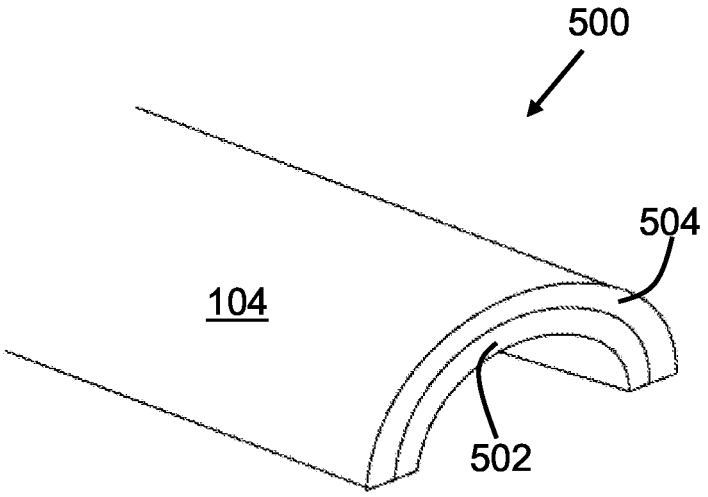
FIG. 5 illustrates a sectioned view of an exemplary panel having a spring metal layer and a silicone layer, in accordance with an embodiment of the present invention.

Looking ahead to FIG. 5, the curved form 500 of the panel 102 is adapted to completely wrap around an exterior surface of a public handle 110. The spring metal 502 material enables the articulation of wrapping around the public handle to be facilitated, as the spring metal is forced to wrap around the public handle. When the device 100 is not being used, a straight, semi-rigid form 800 of the panel 102 defines a rectangular shape (See FIG. 8). The spring metal 502 material facilitates removal of the panel 102 due to the configuration thereof.

Figure 6:
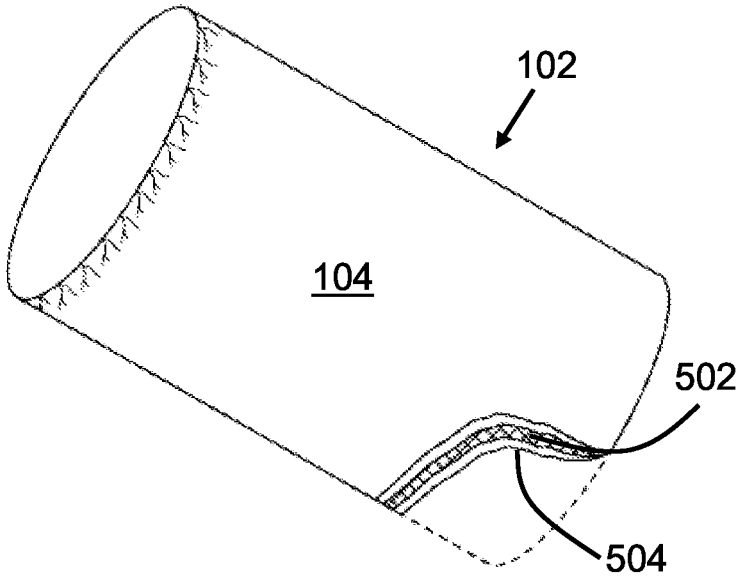
FIG. 6 illustrates a partially sectioned view of the panel shown in FIG. 5, showing the spring metal layer and the silicone layer, in accordance with an embodiment of the present invention.

In some embodiments, the panel 102 defines a predetermined length, width, and thickness. Furthermore, a first layer of the panel 102 is formed of a resilient flexible metal material shaped with a width-wise arc. For example, FIG. 6 shows a cut-out view of the panel 102 in the semi-rigid position 800 position, showing the silicon layer encapsulating the layer of spring metal 502. However, in alternative embodiments, square, circular, triangular, or irregular shapes may also be used for the panel.

Those skilled in the art will recognize that a public handle 110 comprises a vertical or horizontal handle bar in a public transportation vehicle. For purposed of the present disclosure, the public handle 110 may also include a hand rail, a vertical pole, a horizontal pole, a straphanger, and a bus stop pole. Thus, the panel 102 wraps around the public handle 110 when slapped against the surface thereof. When slapped against the public handle 110, the panel 102 automatically forms to the public handle 110; thereby securing the panel 102 in place for safe handling. Nonetheless, when in the curled position, the panel 102 can still be advanced along the longitudinal of the public handle 110, such as a bus pole, so as to make space for someone else to hold.

Figure 7:
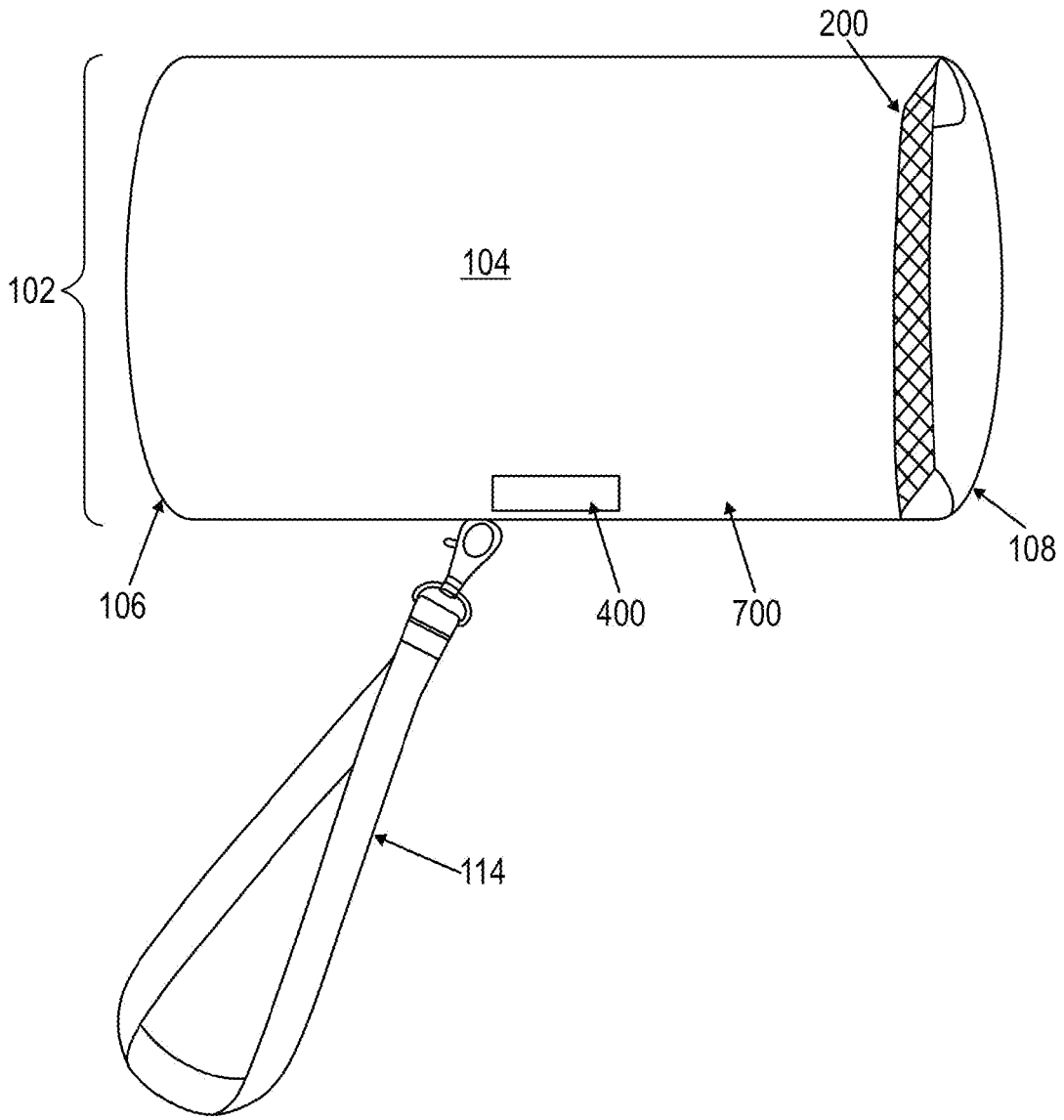
FIG. 7 illustrates a top view of the hygienic protective cover device, in accordance with an embodiment of the present invention.
Figure 8:
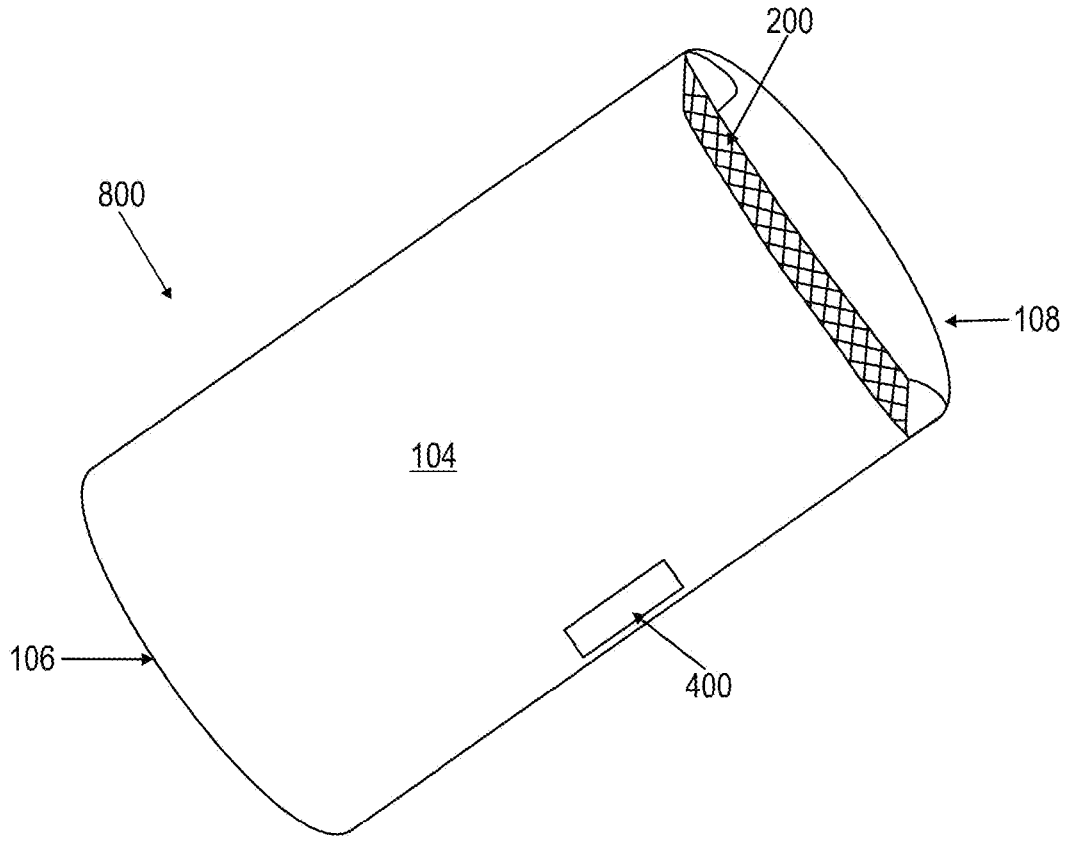
FIG. 8 illustrates an upper perspective view of the hygienic protective cover device, showing the protruding handle, in accordance with an embodiment of the present invention.

Turning back to FIG. 4, the panel 102 defines a perimeter region 700 that extends around the panel 102. An aperture 400 may form at the perimeter region 700. The aperture 400 is sized and dimensioned to enable passage of a lanyard 114. In other embodiments, the aperture 400 defines a rectangular shape. In one exemplary use, a rectangular aperture allows the option of attaching a lanyard 114 for storage or traveling purposes. FIG. 7 illustrates the lanyard 114 in relation to the panel 102. A ring 116 is at the terminus of the lanyard 114 to mount the device 100 when not in use.

In some embodiments, a silicone layer 504 encapsulates the panel 102. The silicone layer 504 comprises a silicone material that is configured to minimize the transfer of germs between the panel 102, the hand 112, and the public handle 110. This may include medical grade or food grade silicone. As the hand 112 wraps around the silicone layer 504, there is less opportunity for germs to stick to the hand from the public handle 110.

Figure 9:
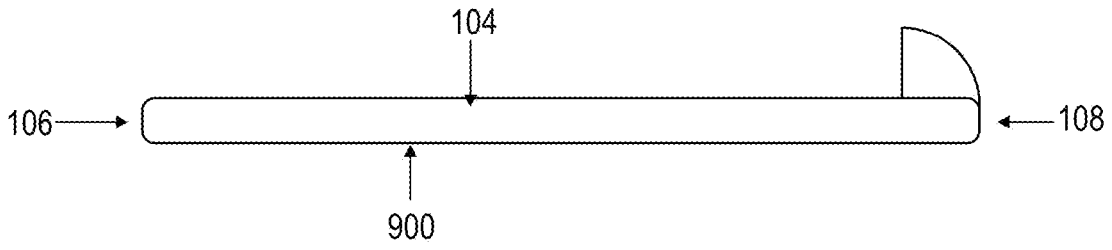
FIG. 9 illustrates an elevated left side view of the hygienic protective cover device, showing the protruding handle, in accordance with an embodiment of the present invention.
Figure 10:
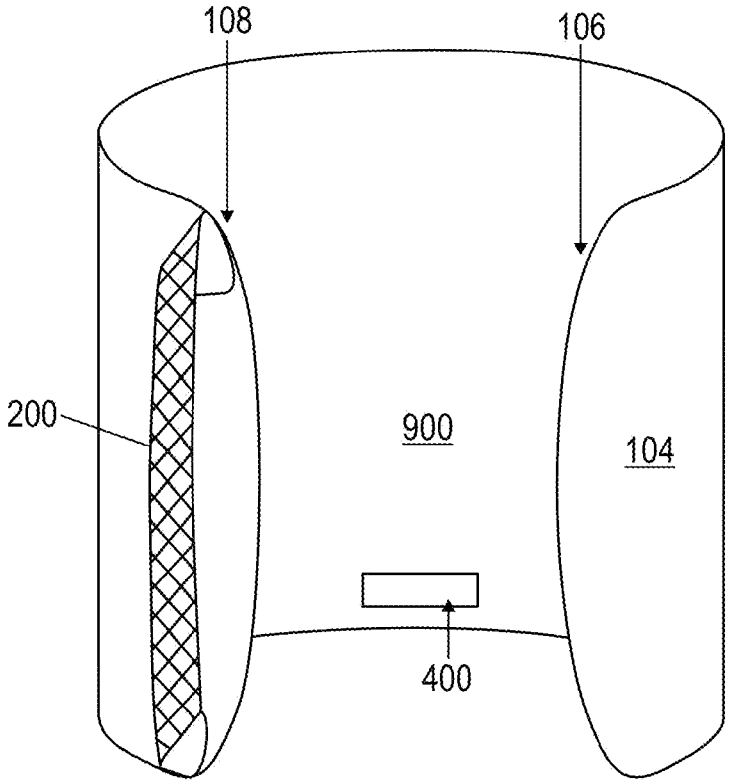
FIG. 10 illustrates a frontal view of the hygienic protective cover device, in accordance with an embodiment of the present invention.

As shown in FIG. 9, the device 100 further comprises a protruding grip 200 that is disposed on the outer side 104 of the cover. In some embodiments, the protruding grip 200 may be elongated. In one possible embodiment, the silicone layer 504 encapsulates the protruding grip 200. The protruding grip 200 may be more proximal to the second end 108 of the panel 102.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hygienic protective cover device, comprising:

a flexible panel defining an inner side and an outer side, wherein the flexible panel having a curved first end and a curved second end, the flexible panel has a rectangular shape with a plurality of rounded corners at each of the first end and the second end, the plurality of rounded corners includes:

a first rounded corner and a second rounded corner at the first end, a third rounded corner and a fourth rounded corner at the second end, the flexible panel has a width and a length, the length of flexible panel is longer than the width of the flexible panel, the flexible panel further comprising a spring metal material, the spring metal is configured to enable the flexible panel to transfer between a straight, semi-rigid form, and a curved form;

a protruding grip disposed on the second end of the flexible panel, wherein the protruding grip extends from the third rounded corner to the first rounded corner;

a silicone layer encapsulating the flexible panel, wherein the silicone layer comprising a silicone material configured to minimize the transfer of germs.

2. The hygienic protective cover device of claim 1, wherein the spring metal comprises a bi-stable ribbon spring.

3. The hygienic protective cover device of claim 1, wherein the protruding grip is elongated.

4. The hygienic protective cover device of claim 1, wherein the flexible panel has a first end and a second end.

5. The hygienic protective cover device of claim 1, wherein the flexible panel has a perimeter region.

6. The hygienic protective cover device of claim 5, wherein the flexible panel defines an aperture disposed at the perimeter region.

7. The hygienic protective cover device of claim 6, wherein the aperture enables passage of a lanyard.

8. The hygienic protective cover device of claim 6, wherein the aperture defines a rectangular shape.

9. The hygienic protective cover device of claim 1, wherein the straight, semi-rigid form of the panel defines a rectangular shape.

10. The hygienic protective cover device of claim 1, wherein the curved form of the panel is adapted to completely wrap around an exterior surface of a public handle.

11. The hygienic protective cover device of claim 10, wherein the public handle comprises a vertical or horizontal handle bar in a public transportation vehicle.

12. A hygienic protective cover device, the device comprising:

a flexible panel defining an inner side, an outer side, and a perimeter region, wherein the flexible panel further defining an aperture disposed at the perimeter region, the flexible panel comprising a bi-stable ribbon spring, the flexible panel having a curved first end and a curved second end, the flexible panel has a rectangular shape with a plurality of rounded corners at each of the first end and the second end, the plurality of rounded corners includes:

a first rounded corner and a second rounded corner at the first end, a third rounded corner and a fourth rounded corner at the second end, the flexible panel has a width and a length, the length of flexible panel is longer than the width of the flexible panel, the bi-stable ribbon spring configured to enable the panel to transfer between a straight, semi-rigid form, and a curved form;

a protruding grip disposed on the second end of the flexible panel wherein the protruding grip extends from the third rounded corner to the first rounded corner; and a silicone layer encapsulating the panel and the protruding grip, wherein the silicone layer comprising a silicone material configured to minimize the transfer of germs.

13. The device of claim 12, wherein the straight, semi-rigid form of the panel defines a rectangular shape.

14. The device of claim 12, wherein the curved form of the panel is adapted to completely wrap around an exterior surface of a public handle.

15. The device of claim 14, wherein the public handle comprises a vertical or horizontal handle bar in a public transportation vehicle.

16. A hygienic protective cover device, the device consisting of:

a flexible panel defining an inner side, an outer side, and a perimeter region, the flexible panel further defining an aperture disposed at the perimeter region, wherein the panel comprising a bi-stable ribbon spring, the bi-stable ribbon spring configured to enable the flexible panel to transfer between a straight, semi-rigid form, and a curved form, the flexible panel having a first end and a second end, the flexible panel has a rectangular shape with a plurality of rounded corners at each of the first end and the second end, the plurality of rounded corners includes:

a first rounded corner and a second rounded corner at the first end, a third rounded corner and a fourth rounded corner at the second end, the flexible panel has a width and a length, the length of the flexible panel is larger than the width of the flexible panel, a protruding grip disposed on the second end of the flexible panel, wherein the protruding grip extends from the third rounded corner to the first rounded corner.

* * * * *